US006147607A

United States Patent [19]

Lynn

[11] Patent Number: 6,147,607

[45] **Date of Patent: *Nov. 14, 2000**

[54] METHOD AND APPARATUS FOR HELPING TO ASSURE THE WASHING OF HANDS

[76] Inventor: John M. Lynn, 8616 Mendocino Dr., Austin, Tex. 78735

[ * ] Notice: This patent is subject to a terminal disclaimer.

[21] Appl. No.: 09/371,825

[22] Filed: Aug. 11, 1999

Related U.S. Application Data

[63] Continuation-in-part of application No. 09/170,172, Oct. 13, 1998, Pat. No. 6,031,461.

[51] Int. Cl.[7] ..... G08B 23/00

[52] U.S. Cl. ..... 340/573.1; 222/39; 106/31.32; 424/9.71; 428/41.1; 422/186; 422/291; 292/347

[58] Field of Search ..... 340/573.1; 222/39; 106/31.32; 424/9.71; 428/61.1; 422/186, 291; 292/347

[56] References Cited

U.S. PATENT DOCUMENTS

| | | | |
|---|---|---|---|
| 1,491,780 | 4/1924 | Abbott | 292/347 |
| 1,783,097 | 11/1930 | Polcari | 292/347 |
| 2,044,904 | 6/1936 | Heisig . | |
| 2,527,955 | 10/1950 | Pagel | 422/291 |
| 3,314,746 | 4/1967 | Millar | 422/186 |
| 3,877,005 | 4/1975 | Apgar | 340/304 |
| 4,431,628 | 2/1984 | Gaffar | 424/9.71 |
| 4,832,942 | 5/1989 | Crace | 428/41.1 |
| 4,856,140 | 8/1989 | Visco et al. | 16/412 |
| 5,043,013 | 8/1991 | Kluger et al. | 106/31.32 |
| 5,810,201 | 9/1998 | Besse et al. | 222/39 |
| 5,812,059 | 9/1998 | Shaw et al. | 340/573.1 |
| 5,870,015 | 2/1999 | Hinkel | 340/573.1 |

FOREIGN PATENT DOCUMENTS 567512 1/1933 Germany .

OTHER PUBLICATIONS

International Search Report for PCT/US99/23560, Jan. 21, 2000.

*Primary Examiner*—Benjamin C. Lee
*Attorney, Agent, or Firm*—Baker Botts L.L.P.

[57] ABSTRACT

A method and apparatus are disclosed for helping to assure the washing of hands. An easily identifiable substance is provided which can be removed by washing, and a marking mechanism is coupled to the easily identifiable substance. A hand of a person is then marked with the easily identifiable substance when the marking mechanism is triggered. In one embodiment, a flush mechanism of a toilet or urinal is equipped with the marking mechanism, and the marking mechanism is triggered when a person flushes the toilet or urinal. In another embodiment, a door handle is equipped with the marking mechanism, and the marking mechanism is triggered when a person uses the door handle.

28 Claims, 1 Drawing Sheet

FIG. 1

METHOD AND APPARATUS FOR HELPING TO ASSURE THE WASHING OF HANDS

RELATED APPLICATION

This application is a continuation in part of application Ser. No. 09/170,172 filed Oct. 13, 1998 entitled: Method and Apparatus for Helping to Assure the Washing of Hands, now issued as U.S. Pat. No. 6,031,461.

TECHNICAL FIELD OF THE INVENTION

The present invention relates in general to the field of maintaining sanitary areas, to a method and apparatus for helping to assure the washing of hands, and, more particularly, to doing so by marking a person's hands with an easily identifiable substance that requires washing of their hands to remove the substance.

BACKGROUND OF THE INVENTION

In a variety of different fields and businesses, there is a need for assuring that persons who enter certain areas or exit certain areas have sanitized their hands prior to entry or exit. Obvious examples include food preparers and health care workers (although there are other potential examples too numerous to list). An example of a specific need for assuring sanitized hands is the restaurant industry. It has been known for many decades that food preparers, servers and so forth should clean and sanitize their hands prior to handling others' food. This need is self-evident after restaurant employees have been in restrooms/toilets. Bacteria (such as *E-coli* and fecal matter) in restrooms/toilets, are well known problems and without proper cleaning/sanitization of the hands of restaurant employees the problem can be transmitted to unknowing customers. There is also a need for sanitized hands in private residences. This is especially true of homes with children. Physicians have known for many years that washing one's hands frequently (and especially after use of the bathroom) is a very important factor in minimizing illness.

In the past, restaurants and parents have tried to address the problem by rules and regulations concerning hand washing. For instance, in many restaurants there are signs which state roughly "Employees must wash their hands before leaving." Obviously, methods which require adherence to a rule or policy by human beings are insufficient to assure foolproof compliance. Thus, there is a strong need for a method of assuring that people have sanitized their hands, and, in particular, have done so before entry is allowed into certain areas.

Presently there are both patented and un-patented systems intended to address this problem. These systems are either not foolproof (i.e., require individual compliance with rules) or are complex and accordingly prohibitively expensive. U.S. Pat. No. 5,670,945, for example, discloses a complex system that has a sanitizing basin with moisture proof switches inside the sanitizing basin and proximity detectors. A person must insert both hands simultaneously into the sanitizing basin in order to initiate the desired output signal. U.S. Pat. Nos. 5,202,666; 4,896,144; 3,967,478; 5,610,589; 4,688,585 and 5,199,188 all involve complex systems containing such things as electronics, sensors, pumps and so forth. Additionally, none of these systems effectively assure that an unintentional improper sanitizing of a worker's hands will be detected.

There is a need for a foolproof, simple and inexpensive method to assure that persons wash their hands before exiting unsanitary areas or entering sanitary areas. Especially desirable is a system that is simple and inexpensive enough to allow it to be retrofitted into existing bathrooms in commercial and residential locations.

SUMMARY OF THE INVENTION

In accordance with the present invention, a method and apparatus are disclosed for helping to assure the washing of hands that provide advantages over prior sanitization schemes.

According to one aspect of the present invention, a method for helping to assure washing of hands involves providing an easily identifiable substance which can be removed by washing with a sanitizing medium for a period of time sufficient to help assure sanitation of the hands. A marking mechanism is coupled to the easily identifiable substance, and a hand of a person is then marked with the easily identifiable substance when the marking mechanism is triggered by an event in where washing of the hands is desired. The marking mechanism may be incorporated into the actuating mechanism as an integral part thereof (e.g. the marking mechanism may be embedded into a door knob).

According to another aspect of the present invention, an apparatus for helping to assure washing of hands includes an easily identifiable substance which can be removed by washing. A marking mechanism is coupled to the easily identifiable substance, and the marking mechanism is operable to mark a hand of a person with the easily identifiable substance when the marking mechanism is triggered.

In one implementation, a flush mechanism of a toilet or urinal may be coupled to the marking mechanism, and the marking mechanism triggered when a person flushes the toilet or urinal. In another embodiment, a door handle may be coupled with the marking mechanism, and the marking mechanism triggered when a person uses the door handle.

In addition to door handle and toilet flush mechanisms the present invention may be used in any situation where it is desirable that a person washes their hands. Medical studies show that washing hands numerous times a day dramatically decreases illnesses. Accordingly the invention could be used in various entrances or apparatuses such as a home entrance or the entrance of a refrigerator.

It is a technical advantage of the present invention that it assures individuals wash their hands by marking their hands with an easily identifiable substance.

It is another technical advantage of the present invention that a relatively simple and inexpensive system and method are provided which may be retrofitted into existing commercial and residential restrooms and entrances to existing commercial and residential sanitary areas.

Other technical advantages of the present invention should be apparent from the drawings, specification and claims.

BRIEF DESCRIPTION OF THE DRAWINGS

A more complete and thorough understanding of the present invention and advantages thereof may be acquired by referring to the following description taken in conjunction with the accompanying drawings, in which like reference numbers indicate like features, and wherein.

DETAILED DESCRIPTION OF THE INVENTION

Figure 1:
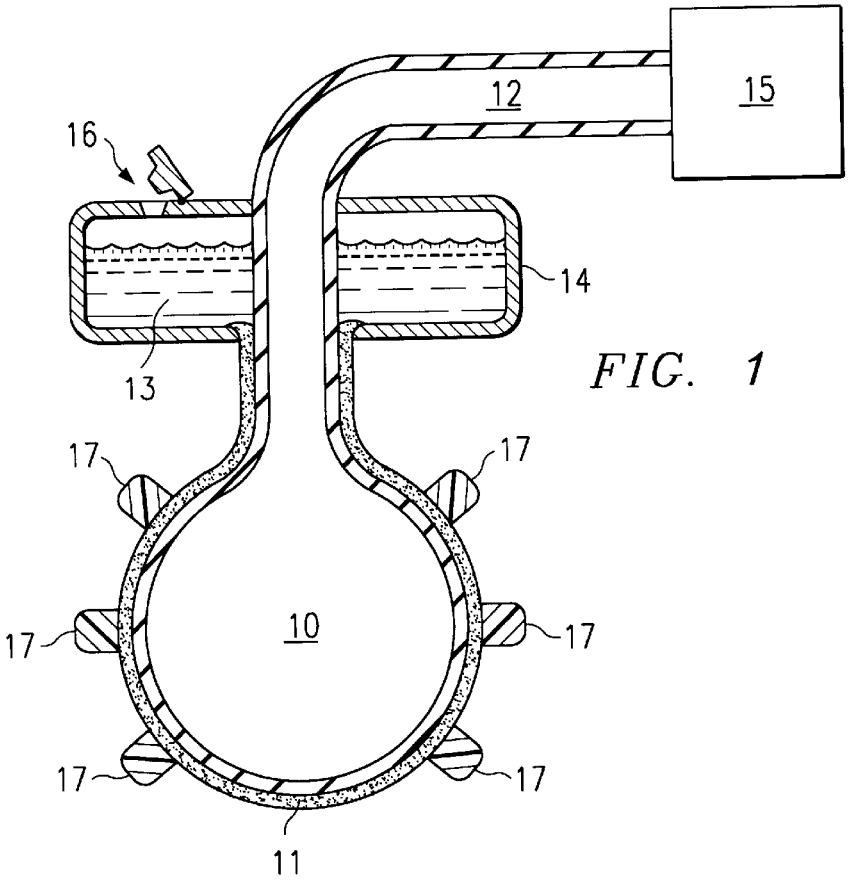
FIG. 1 is a cross-section of one embodiment of a toilet flushing mechanism with a marking mechanism.

FIG. 1 is a cross-section of one embodiment of a toilet flushing system with a marking mechanism. In the embodiment of FIG. 1, the marking mechanism comprises a compressible bulb 10 connected to (or integral with) a pneumatic hose 12. By squeezing bulb 10, this forces air into hose 12 which signal (or event) can be used in a variety of different ways to flush a toilet using flushing mechanism 15. Those skilled in the art should recognize that both the marking mechanism 10 or the flushing mechanism 15 could be any of a large number well known and commercially available mechanisms such as any of the following types of systems: (1) mechanical, (2) pneumatic, (3) pneumatic (mechanical), (4) electronic and (5) any combination thereof. The present invention can provide benefits to any such flushing mechanism, and the specific type of flushing mechanism is relatively unimportant.

The flushing mechanism shown in FIG. 1 represents one example of an actuating mechanism satisfactory for use with the present invention. A door knob or other type of operating mechanism may also satisfactorily function as an actuating mechanism in accordance with the teachings of the present invention. A wide variety of components such as the flushing mechanism of FIG. 1 and a door operating mechanism may be satisfactorily used as an actuating mechanism associated with an event where washing of the person's hands is desirable.

In the embodiment of FIG. 1, the marking mechanism operates as a mechanical trigger and further comprises an absorbing material 11 which covers, or is an integral part of, bulb 10. Absorbing material 11 contains or is saturated with an easily identifiable substance 13 which is held in container 14. In one embodiment, container 14, the easily identifiable substance 13 and absorbing material 11 are designed such that absorbing material 11 always contains enough of the easily identifiable substance 13 to mark a person's hands who squeezes bulb 10. One of many methods to assure a steady supply of an easily identifiable substance 13 is to gravity feed the easily identifiable substance 13 to absorbing material 11. Easily identifiable substance 13 can be re-filled into container 14, for example through opening 16.

Easily identifiable substance 13 can be any of a number of substances which are commercially available and well known in the art. Important characteristics of substance 13 are that it clearly marks a person's hands, be non-toxic and be washable with a sanitizing medium such as soap and water or some other desirable cleansing or disinfecting solution. Likewise, the easily identifiable substance 13 should not dry out when it is on absorbing material 11. Easily identifiable substance 13 could be, for example, a paint, dye, chalk, stain, ink, grease, pigment or combination thereof which will clearly mark a person's hand(s). In addition to visual markings, markings may be invisible to the naked eye (for example, certain phosphors) which become visible when exposed to certain mediums such as ultraviolet (UV) light. Invisible markings which become easily identifiable when exposed to certain mediums such as UV light would be especially useful in circumstances where an organization wanted to monitor its employees but not its customers. For example, if a restaurant equips its restroom door with the invention, Its customers will not be visibly marked but the restaurant can monitor its employees by exposing the easily identifiable, yet invisible, substance to UV light.

A preferred method to discriminate between classes of users such as employees and customers, is to provide a second door opening mechanism in accordance with teachings of the present invention on the restroom door. The second door opening means may be a standard door opening mechanism that is locked until it is opened by a key or another opening device such as an electronic or magnetic device as set forth in U.S. Pat. Nos. 4,534,194; 5,609,051; 5,475,996; and 5,337,588. The key or opening device could be accessible only to customers and not employees, making obvious any attempts by an employee to bypass the apparatus of the current invention.

Substance 13 can be chosen or designed in accordance with teachings of the present invention such that the desired type of hand washing is necessitated. For example, substance 13 can be designed such that it can only be removed by washing with soap and water for a sufficient period of time to maximize sanitation of a person's hands (and at the same time does not come off easily with water alone). Likewise, in a highly sanitary area such as a hospital, substance 13 may be designed in accordance with teachings of the present invention to be removable only by washing with a desired alcohol based solution or another desired type of sanitary medium. The present invention allows selecting the desired sanitizing fluid (soap, water, alcohol, or antibacterial solution) and the desired cleaning techniques.

In one embodiment of the present invention the marking mechanism is manually triggered such that it will mark a person's hands quite thoroughly (e.g., even between the fingers) with an easily identifiable solution 13 and accordingly it forces the person to clean the marked hand (and obviously the other hand as well) even more thoroughly than might normally be done. This thorough cleaning of the hands is an added benefit of the present invention. Further, the thorough marking of the hand with an easily identifiable solution 13 can be optimized by designing the marking mechanism such that the easily identifiable substance 13 is deposited between the fingers. In another embodiment the marking mechanism has finger guides 17 which force a person's fingers apart such that when the person squeezes bulb 10 through absorbing material 11 the easily identifiable substance 13 is deposited between the person's fingers. The finger guides 17 have the added benefit of making it more difficult (or impossible) to bypass the entire system by using a paper towel or cloth to activate the marking mechanism and accordingly avoiding contact with the easily identifiable substance 13 on the person's hands. In another embodiment of the invention the marking mechanisms disclosed herein can be used redundantly with a back up electronic detection system to determine if a person has entered a restroom or not. One such electronic system using name tags is disclosed in U.S. Pat. No. 5,610,589.

In general, according to this aspect of the present invention, the flushing mechanism of a toilet (and/or urinal) can be equipped with a marking mechanism that marks a person's hand with an easily identifiable substance when the toilet is flushed. Thus, the person using the toilet must then either not flush the toilet (obviously not a viable alternative) or have their hand marked by the easily identifiable substance. The easily identifiable substance can then be removed only by using soap or another sanitizing agent which also sanitizes the person's hands. Depending on the situation, the easily identifiable substance can be designed to be compatible with an optimum cleaning medium. For example, in a restroom, the easily identifiable substance 13 should be designed to optimize hand cleaning (e.g., both as to duration and effort) with an antibacterial soap.

As shown, the marking mechanism can be manually triggered and preferably designed such that in order to flush the toilet the hand doing the flushing is thoroughly marked with the easily identifiable substance. Accordingly it takes a thorough washing of the hand to clean off the easily identifiable substance. The easily identifiable substance is preferably non-toxic, highly a visible and not washable with only water but washable quite easily with a thorough hand washing with a sanitizing solution (for example, an antibacterial soap). Clearly, the only practical way to thoroughly wash one hand is to use the other hand also, resulting in two clean and sanitized hands.

Figure 2:
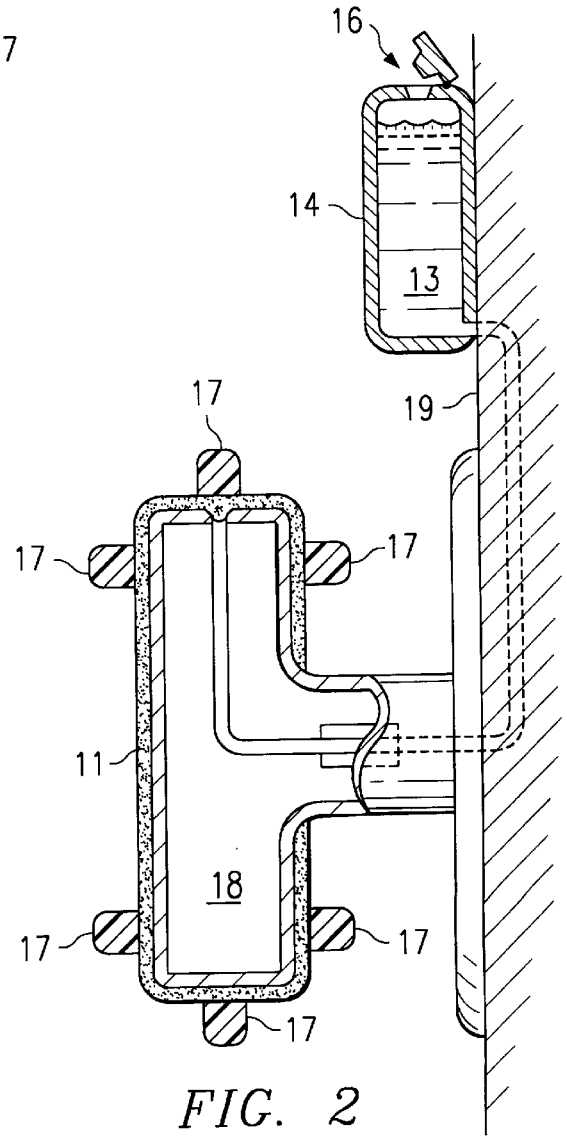
FIG. 2 is a cross-section of one embodiment of a door knob equipped with a marking mechanism.

FIG. 2 is a cross-section of one embodiment of a door knob or other door opening mechanism equipped with a marking mechanism. In this embodiment, the marking mechanism is connected to an entrance door 19 to an unsanitary area such as a restroom or a sanitary area such as a restaurant food preparation area. Preferably door 19 shuts automatically (for example, using well known methods such as spring loaded or pneumatic door closers) so that people cannot bypass the marking mechanism by simply leaving the door ajar. Alternatively the door could be designed such that when it is ajar (i.e. open enough such that one can bypass the door opening mechanism) it is readily apparent to supervisory personnel (e.g. a signal of some type is incorporated). As shown in FIG. 2, the absorbing material 11 covers door knob 18 which allows entry to a sanitary area or unsanitary area. The container 14 with an easily identifiable substance 13 is positioned above door knob 18 and gravity feeds the easily identifiable substance 13 onto absorbing material 11. If a person who wants to enter the sanitary area must use door knob 18, then their hand will necessarily be marked with the easily identifiable substance 13. Similar to the trigger mechanism of FIG. 1, door knob 18 can also have finger guides 17 to assure thorough marking of the hand and disallow using paper towels or cloth to bypass the system. Again, as with the above embodiment, once the hands are marked, the person must thoroughly clean their hands to remove the easily identifiable substance 13.

For some applications, a second door opening or operating mechanism (not expressly shown) may be provided on entrance door 19 to allow customers or other personnel who are not subject to requirements for thoroughly clean or sanitizing their hands to bypass door knob 18 and easily identifiable substance 13. For example, the manager of a restaurant or similar facility may be provided with a key which would deactivate and/or bypass door knob 18 and allow the second door operating mechanism to open entrance door 19. The restaurant manager could make the key available only to customers and other personnel who are not subject to the same requirements as food preparation and food handling personnel working for the restaurant. For example the key could be place in a highly visible area of the restaurant.

For still other applications a mechanism may be provided to indicate when an attempt has been made to bypass or prevent the marking mechanism from marking a person's hand. One example of such a mechanism is a rough, hook like surface such as typically associated with Velcro® material (not expressly shown) placed on the exterior of a toilet/urinal flushing mechanism or on the exterior of door knob 18 to indicate when a piece of cloth, paper, or similar material has been used to prevent easily identifiable substance 13 from contacting a person's hand. The rough, hook like surface would preferably be selected to be compatible with operating of the flushing mechanism or door knob 18 with a person's hand but would indicate when a piece of cloth or paper was placed thereon to prevent easily identifiable substance 13 from marking a person's hand. This application would be especially useful in residences where a limited number of people use the flushing mechanism and attempts to bypass it are easier to trace to a particular person.

In a preferred embodiment of the invention the marking of the hand used to open the door is done in such a way that during the interim period between marking the hand and washing the hand, the easily identifiable substance is formulated and marked on the hand in such a way that smearing or staining of clothes or other items is minimized. In the most preferred embodiment the easily identifiable substance is comprised of a composition which is removable from clothes and other items by washing them in the unusual cases where smearing or staining does occur. For an example of an easily identifiable substance that is washable see U.S. Pat. No. 5,043,013 issued to Kluger et al. entitled "Washable Ink Compositions". This minimization of smearing and staining and ultimate washability of the easily identifiable substance is especially important in the embodiment of the invention where the marking mechanism is at the entrance to a restroom. Obviously, in such a case, the marking should be done in such a way the person's clothes or other items in the restroom are not smeared or stained by the person's hands as they utilize the facilities.

Minimization of smearing and staining can be accomplished, by among other tactics, in the following two ways. First, the mark or marks can be relatively small and in the palm of the person's hand and/or between the fingers and/or on the back of the hand or fingers. This is preferred over marking the fingertips or the inside of the fingers where the mark is more likely to come into contact with various items as the hand is utilized. Second, the easily identifiable substance should be formulated and applied very thinly in such a way that it is essentially dry to the touch and non-smearing very quickly after the hand is marked.

In another preferred embodiment of the invention, the mark can be made by a well known method called stamping (see U.S. Pat. No. 5,826,515 entitled a "Stamping Device" which is incorporated herein by reference). Stamps are well known in the art and usually include a separate ink pad. A preferred stamp for this invention is self-inking with the marking nib integral with the housing for the easily identifiable substance/ink. Such a stamping device would include a housing having a first end, a second end, and a passageway therebetween, an image nib attached to the second end of the housing having an outwardly projecting face portion with a raised image formed thereon and an absorbent transfer medium or insert member compressibly disposed within the passageway of the housing in contact with the image nib. In use, the passageway is adapted to receive a marking nib of a writing instrument, such as a marker, at the first end of the housing. When the marking nib of the writing instrument is inserted into the passageway, easily identifiable substance/ink flows from the writing instrument to the absorbent insert member and then to the image nib. Once the image nib is saturated with the easily identifiable substance/ink, an inked reproduction of the raised image formed on the image nib may be transferred to a person's hand by pressing the outwardly projecting face portion of the image nib against the person's hand.

Stamping has been done for years at entertainment events to mark people so that they can come and go from the event and it is clear that they have already paid the entrance fee upon readmission. Another popular and well known use of stamping is for children's games and arts and crafts. In fact, such children's stamps using colored ink or dye work well because they are easily identifiable, the ink or dye is applied thinly and it drys to the touch almost immediately. These commercially available stamps are also ideal because they are non-toxic and can be removed with a thorough washing of the hands with soap and water. Many such inks or dyes are know in the medicinal or cosmetic fields as being safe and effective for marking human skin. Many such dyes and/or inks are disclosed in U.S. Pat. No. 4,169,169 issued to Kitabatake and U.S. Pat. No. 5,043,013 issued to Kluger et al. both of which are incorporated herein by reference.

Aqueous ink/dye compositions are especially preferred because they are normally washable with soap and water. One such washable ink composition contains polyalkyleneoxy-substituted, polar group-substituted chromophore compounds. Particularly preferred ink compositions will have a high molecular weight colorant. This is because such colorants are less toxic to humans and may not require other solvents. Such an aqueous ink composition may contain from about forty percent by weight to about eighty percent by weight of water; from about ten percent by weight to about fifty percent by weight of polymeric colorant containing a polar chromophore with from about ten percent by weight to about fifty percent by weight of polyalkylene oxide units. The polymeric colorants selected for the washable ink compositions contain from about five percent by weight to forty percent by weight of a polyalkylene oxide (preferably ethylene oxide). In addition it may be desirable to add well known additives such as humectants (to prevent drying out of the marking mechanism), and cholating agents (to improve shelf life).

It is important to note that the easily identifiable substances should not be easily removable with just water. The preferred removal time with soap and water or another sanitary medium is often between 10 seconds and 2 minutes. The most preferred removal time is typically between 20 seconds and one minute. A shorter removal time may result in insufficient sanitation of the hands and a longer period risks the problems of diminishing returns, waste of time, and frustration of the user (which could result in increased attempts to bypass the system).

Examples of children's stamps which work well in the marking of a person's hand are "Stamping Fun" from Crayola and "Lite Up Crystal Stampers" from Rose Art. The inks in these products are water based products (allowing removal with water) with dry pigments added. As an added benefit these products are also advertised as being removable by washing from clothing and other items. Experiments were run using these stamping products. The palm of a person's hand was stamped using each of the above mentioned products separately. Immediately after stamping it was observed that the mark on the palm was dry to the touch and would not smear on clothes. Within 30–60 seconds after stamping the palm the hand was washed (using the other hand in a normal scrubbing motion) using only water. After more than one minute of such washing the mark was still not completely gone for either product. The experiments were then rerun exactly in the same manner except that water and soap were used (the soap was standard Kimberly and Clark liquid soap which comes out of restroom dispensers). When soap was used, the marks left by the stamps were removable with a normal washing of the hands of between 30–45 seconds. Experiments were also run with two different types of children's markers but they were not preferred because the mark came off very quickly (less than 5–10 seconds) and easily with only water. These non-preferred markers were "Kids First" and "Travel Games/Dry Erase/Color Wipeoffs" both from Crayola. Obviously such easily removable marks would not force persons to wash well with both soap and water.

Figure 3:
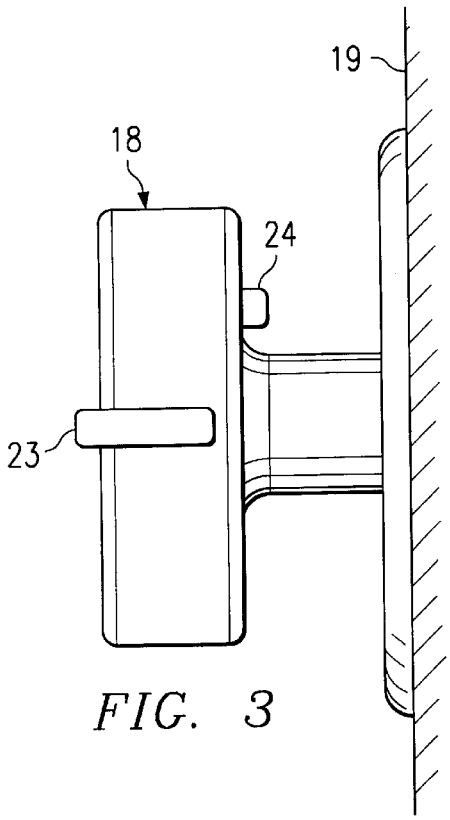
FIG. 3 is a schematic drawing in section with portions broken away showing a door knob incorporating a further embodiment of the present invention.

This preferred method of using a stamp as the marking mechanism to mark the palm of persons hand is illustrated in FIG. 3. As in FIG. 2, the stamp/marking mechanism 23 is coupled with door knob 18 which allows entry into a sanitary or an unsanitary area through entrance 19. Door knob 18 contains stamp 23 which protrudes slightly out of door knob 18. Stamp 23 may be designed such that it is easily removable and replaceable when it runs out of easily identifiable substance 13. This could be done by either replacing the entire stamp 23 or a cartridge containing easily identifiable substance 13. Stamp 23 represents one example of a replaceable container satisfactory for use in an apparatus for helping to assure washing of a person's hands. A wide variety of replaceable containers may also be satisfactorily used in accordance with teachings of the present invention.

In addition, to preventing stamp 23 from drying out, stamp 23 may be covered with a retractable cap (not expressly shown) which keeps easily identifiable substance 13 wet or moist. Stamp 23 is preferably centrally positioned so that it will mark a person's hand in the palm. To force the person to put their hand against stamp 23, door knob 18 preferably has a standard unlocking mechanism 24 which must be activated to turn door knob 18. By positioning unlocking mechanism 24 on the backside of door knob 18 and sizing and shaping door knob 18 correctly, unlocking mechanism 24 forces a person to put the palm of their hand against stamp 23 thereby marking their hand with easily identifiable substance 13. For children's restrooms the door knob should be sized small enough to allow a child to use the door knob but large enough that the child's hand will be marked by stamp 23.

In general, according to this additional aspect of the present invention, the entrance to a sanitary area can be equipped with the marking mechanism. An example, as shown in FIG. 2, would be to equip the door knob of the sanitary area with the marking mechanism which is manually triggered. The design would ensure that a person entering must thoroughly wash their hands after entering the sanitary area or alternatively be easily identifiable as not having washed their hands. This embodiment would work well, for example, in areas such as entrances to cooking areas in restaurants, sanitary areas in hospitals, and high technology clean rooms. As discussed above, the easily identifiable substance could be chosen to optimize hand cleaning depending on the end use. For example, before entering a high-technology clean room the main goal may be to minimize particulates rather than bacterial contamination. Accordingly, the easily identifiable substance may be chalk, pigment or another particulate substance rather than a liquid.

As an example in a hospital or medical facility one might want a person to wash with alcohol rather than water and accordingly a water insoluble ink or dye may be preferred. Examples of nontoxic oil dyes permitted to be used in medicine and cosmetics include red dyes such as 3-esoacetate of 9-o-carboxyphenyl-6-diethylamino-3-ethylimino-3-iso-xanthene (the legal name of this dye being Red No. 215, the general name being Rhodamine B Stearate), 2,4,5,7-tetrabromo-12,13,14,15-tetrachloro-3,6,-fluorandiol (Red No. 218, Tetrachlorotetrabromofluorescein), 2,4,5,7-tettrabromo-3,6-fluorandiol (Red No. 223, Tetrabromofluorescein), 1-p-phenylazo-phenylazo-2-naphthol (Red No. 225, Sudan III), o-tolylazo-o-tolylazo-2-naphthol (Red No. 501, Medical Scarlet), 1-xylylazo-2-naphthol (Red No. 505, Oil Red XO), orange dyes such as 4,5-dibromo-3,6-flourandiol (Orange No. 201, Dibromofluorescein), 1-o-tolylazo-2-naphthol (Orange No. 403, Orange SS), 4,5-diiodo-3,6-fluorandiol (Orange No. 206, Diiodofluorescein), yellow dyes such as 3,6-fluorandiol (Yellow No. 201, Fluorescein), 2-(2-quinolyl)-1,3-indandione (Yellow No. 204, Quinoline Yellow SS), 1-phenylazo-2-naphthylamine (Yellow No. 404, Yellow AB), 1-o-tolylazo-2-naphthylamine (Yellow No. 405, Yellow OB), green dyes such as 1,4-bis (p-toluino) anthraquinone (Green No. 202, Quinizarin Green SS), blue dyes such as 1-methyamino-4-o-tolylaminoanthraquinone (Blue No. 403, Sudan Blue B), and violet dyes such as 1-hydroxy-4-p-toluinoanthraquinone (Violet No. 201, Arizroll Purple SS).

The ink may also include other additives such as binders, plasticizers (e.g. citric acid ester) and solvents. The solvents could be any organic solvent which can dissolve the binders and dyes. Examples include aromatic hydrocarbons such as toluol and xylol (and perhaps even water). The binders may be cellulose derivatives or synthetic resins than can dissolve the dye. Particularly preferred are harmless binders used for food packaging such as ethyl cellulose, methyl cellulose, and carboxy methyl cellulose, ordinarily the dye represents 10–30% by weight of the total weight of the ink.

This notion of "dirtying" one's hands in order to subsequently get them clean may be counter-intuitive, but it could result in especially clean hands if the easily identifiable substance and the cleaning medium are well chosen.

Although the present invention has been described with respect to a specific preferred embodiment thereof, various changes and modifications may be suggested to one skilled in the art and it is intended that the present invention encompass such changes and modifications fall within the scope of the appended claims.

What is claimed is:

1. A method for helping to assure washing of a person's hands, comprising:

providing an easily identifiable substance which can be removed by washing with a sanitizing medium for a period of time sufficient to help assure sanitation of the person's hands;

providing a marking mechanism coupled to the easily identifiable substance; and marking a hand of the person with the easily identifiable substance when the marking mechanism is triggered by an event where washing of the hands is desired.

2. The method of claim 1 further comprising coupling the marking mechanism to a door opening mechanism.

3. The method of claim 2 further comprising using a water based product with pigment or dye added to form at least a portion of the easily identifiable substance.

4. The method of claim 1 further comprising positioning the marking mechanism so that the mark is placed on the palm of the hand or between the fingers of the hand or on the back of the hand or fingers or a combination thereof.

5. The method of claim 1 further comprising using a composition, which is removable from clothing by washing the clothing, to form the easily identifiable substance.

6. The method of claim 1 further comprising coupling the marking mechanism to a toilet or urinal flushing mechanism.

7. The method of claim 6 further comprising positioning the marking mechanism so that the mark is placed on the palm of the hand or between the fingers of the hand or on the back of the hand or fingers or a combination thereof.

8. The method of claim 7 further comprising using a water based product with pigment or dye added to form the easily identifiable substance.

9. The method of claim 7 further comprising using a composition which is removable from clothing by washing the clothing, to form the easily identifiable substance.

10. The method of claim 1 further comprising removing the easily identifiable substance using an alcohol based substance as the sanitizing medium.

11. The method of claim 1 further comprising using hot water to provide at least a part of the sanitizing medium.

12. The method of claim 1 further comprising applying the easily identifiable substance operable to quickly dry to the touch after the marking of the hand.

13. The method of claim 1 further comprising washing the person's hands for a period of time from approximately ten seconds to two minutes to help assure sanitation of the hands.

14. The method of claim 1 further comprising providing a mechanism to allow bypassing of the marking mechanism in order to distinguish between classes of persons associated with the event.

15. The method of claim 1 further comprising providing a mechanism to indicate when an attempt has been made to bypass the marking mechanism.

16. An apparatus for helping to assure the washing of a person's hands, comprising:

an easily identifiable substance which can be removed by washing with a sanitizing medium for a period of time sufficient to help assure sanitation of the person's hands;

a marking mechanism coupled with the easily identifiable substance;

an actuating mechanism associated with an event where washing of the person's hands is desirable; and the marking mechanism operable to mark a hand of the person with the easily identifiable substance when the marking mechanism is triggered by the hand operating the actuating mechanism.

17. The apparatus of claim 16 further comprising the marking mechanism coupled to a door opening mechanism which forms at least a part of the actuating mechanism.

18. The apparatus of claim 17 further comprising a bypass mechanism to allow opening the associated door without contacting the marking mechanism.

19. The apparatus of claim 17 wherein the easily identifiable substance further comprises a water based product with pigment or dye added.

20. The apparatus of claim 16 further comprises the marking mechanism positioned relative to the actuating mechanism whereby the mark is placed on the palm of the hand or between the fingers of the hand or on the back of the hand or fingers or a combination thereof.

21. The apparatus of claim 16 further comprising the easily identifiable substance formed at least in part from a composition removable from clothing by washing the clothing.

22. The apparatus of claim 16 further comprising the actuating mechanism selected from the group consisting of a toilet flushing mechanism, a urinal flushing mechanism or a door opening mechanism.

23. The apparatus of claim 16 further comprising the sanitizing medium selected from the group comprising hot water, an alcohol based solution or an antibacterial solution.

24. The apparatus of claim 16 further comprising:

a first door operating mechanism having the marking mechanism coupled thereto; and a second door operating mechanism to allow bypassing the first door operating mechanism.

25. The apparatus of claim 16 further comprising:

a door opening mechanism having the marking mechanism coupled thereto; and an unlocking mechanism positioned on the door opening mechanism to require that the person's hand firmly engage the door opening mechanism to operate the door.

26. The apparatus of claim 16 further comprising a rough, hook-type surface mounted on the actuating mechanism to indicate if another material has been placed thereon to prevent the marking mechanism from marking the person's hand.

27. An apparatus for helping to assure the washing of a person's hands, comprising:

an easily identifiable substance which can be removed by washing to help assure sanitation of the person's hands;

a marking mechanism and an actuating mechanism associated with an event where washing of the person's hands is desirable;

the marking mechanism operable to mark a hand of the person with the easily identifiable substance when the marking mechanism is triggered by the actuating mechanism responsive to said event; and the easily identifiable substance disposed within a replaceable container coupled with the marking mechanism.

28. A replaceable container for use in an apparatus for helping to assure washing of a person's hands, comprising:

an easily identifiable substance, which can be removed by washing to help assure sanitation of the person's hands, disposed within the replaceable container; and the replaceable container operable to be releasably secured within a marking mechanism to mark a hand of the person with the easily identifiable substance when the marking mechanism is triggered by an event where washing of the hands is desired.

* * * * *